US011158972B2

(12) United States Patent
Schaefer et al.

(10) Patent No.: US 11,158,972 B2
(45) Date of Patent: Oct. 26, 2021

(54) SOCKET CONNECTOR ASSEMBLY

(71) Applicant: TE Connectivity Germany GmbH, Bensheim (DE)

(72) Inventors: Maik Schaefer, Gernsheim (DE); Helge Schmidt, Speyer (DE)

(73) Assignee: TE Connectivity Germany GmbH, Bensheim (DE)

( * ) Notice: Subject to any disclaimer, the term of this patent is extended or adjusted under 35 U.S.C. 154(b) by 82 days.

(21) Appl. No.: 16/547,795

(22) Filed: Aug. 22, 2019

(65) Prior Publication Data

US 2020/0067224 A1 Feb. 27, 2020

(30) Foreign Application Priority Data

Aug. 22, 2018 (DE) ..... 102018214206.8

(51) Int. Cl.

| | |
|---|---|
| ***H01R 11/22*** | (2006.01) |
| ***H01R 13/187*** | (2006.01) |
| ***H01R 13/635*** | (2006.01) |
| ***H01R 4/20*** | (2006.01) |

(52) U.S. Cl.

CPC ..... *H01R 13/187* (2013.01); *H01R 4/206* (2013.01); *H01R 13/635* (2013.01)

(58) Field of Classification Search

CPC ... H01R 13/115; H01R 13/111; H01R 13/187; H01R 11/22

USPC ..... 439/876, 849, 851, 948, 845, 850, 852, 439/860

See application file for complete search history.

(56) References Cited

U.S. PATENT DOCUMENTS

| | | | | |
|---|---|---|---|---|
| 4,934,965 | A * | 6/1990 | Buddrus | H01R 13/113 439/845 |
| 5,562,477 | A | 10/1996 | Moore et al. | |
| 2008/0293287 | A1 | 11/2008 | Zinn | |
| 2019/0097343 | A1 | 3/2019 | Schmidt et al. | |

FOREIGN PATENT DOCUMENTS

| | | | |
|---|---|---|---|
| CN | 201435478 | Y | 3/2010 |
| DE | 3817803 | A1 | 11/1989 |
| DE | 10 2016 110 231 | A1 | 12/2017 |
| FR | 2344977 | A1 | 10/1977 |
| WO | 9843316 | A1 | 10/1998 |

OTHER PUBLICATIONS

European Search Report, App. No. 19192301, dated Jan. 14, 2020, 9 pages.

Translation of CN201435478Y, dated Mar. 31, 2010, 9 pages.

* cited by examiner

*Primary Examiner* — Phuong Chi Thi Nguyen

(74) *Attorney, Agent, or Firm* — Barley Snyder

(57) ABSTRACT

A socket connector assembly is provided and includes a body, a socket connector and a force fit assembly. The socket connector is positioned in the body and includes a socket frame. The socket frame includes an upper side, a lower side positioned opposite the upper side, and a spring assembly connecting the upper side and lower side such that the upper side is moveable relative to the lower side along a height direction. The force fit assembly secures the body to the socket connector.

20 Claims, 6 Drawing Sheets

SOCKET CONNECTOR ASSEMBLY

CROSS-REFERENCE TO RELATED APPLICATION

This application claims the benefit of the filing date under 35 U.S.C. § 119(a)-(d) of German Patent Application No. 102018214206.8, filed on Aug. 22, 2018.

FILED OF THE INVENTION

The invention relates to a socket connector assembly and, more particularly, a socket connector assembly having a socket frame securely held to a body.

BACKGROUND

Socket connector assemblies have applications in many areas. They serve to transmit electrical signals, for example, and are equipped to receive a plug connector. Such socket connector assemblies are usually arranged in a housing. However, there is a need to provide a more secure connection between the housing and the socket connector assembly.

SUMMARY

Accordingly, a socket connector assembly according is provided and includes a body, a socket connector and a force fit assembly. The socket connector is positioned in the body and includes a socket frame. The socket frame includes an upper side, a lower side positioned opposite the upper side, and a spring assembly connecting the upper side and lower side such that the upper side is moveable relative to the lower side along a height direction. The force fit assembly secures the body to the socket connector.

BRIEF DESCRIPTION OF THE DRAWINGS

The invention will now be described by way of example with reference to the accompanying Figures, of which.

DETAILED DESCRIPTION OF THE EMBODIMENTS

Hereinafter, the invention is described in greater detail by way of example using exemplary embodiments with reference to the attached figures. In the figures, elements which correspond to one another in design and/or function are provided with the same reference symbols.

The combination of features shown and described with the individual exemplary embodiments serves solely the purpose of explanation. In accordance with the statements above, it is possible to dispense with a feature from an exemplary embodiment if its technical effect is of no importance in a particular application. Conversely, in accordance with the statements above, a further feature can be added in an exemplary embodiment if its technical effect is meant to be advantageous or necessary to a particular application.

Figure 1:
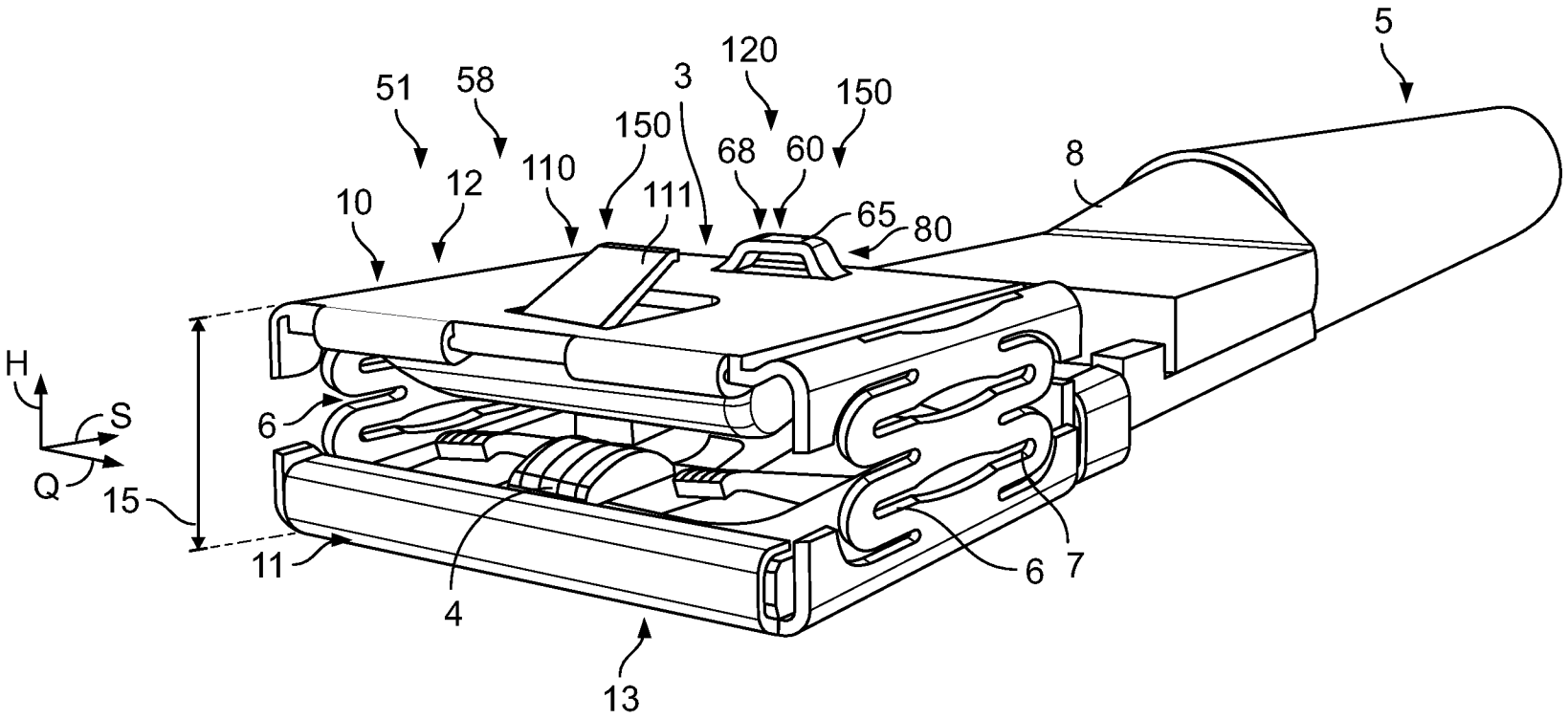
FIG. 1 is a perspective view of a socket connector according to the invention.

A socket connector 10 according to an embodiment of the invention is shown in FIG. 1. The socket connector 10 generally includes a socket frame 3 which has been formed from a metal sheet by stamping and forming, for example. A pair of side walls 6 provided and formed by a spring assembly 7 enables movement of an upper side 12 relative to a lower side 13 of the socket frame 3 along a height direction H. The socket connector 10 can be widened and compressed along the height direction H. In this case, the inner width of a receptacle 11, into which a plug contact 1 (not shown in greater detail in FIG. 1) can be plugged along a plugging direction S into the socket connector 10, is altered. In particular, upon insertion of a plug contact 1, the socket connector 10 and the receptacle 11 are widened and thereby cross over into a widened position.

FIG. 1 shows a force-free state 58, which, in the example shown, is a first widened position 51. By introducing a plug contact 1, the socket connector 10 and the receptacle 11 can be widened further and can cross over into a second widened position. By pressing together the upper side 12 and the lower side 13, the socket connector 10 can be compressed in the height direction H, so that it can be introduced into a body 2. Through this compression, it can cross over into a narrowed position. If the force is removed, the socket connector 10 can automatically go back into the shown first widened position 51 again. Accordingly, a height between the upper side and the lower side can be increased by the widening. The height can in particular also be increased through the plugging-in of a plug contact 1.

The configuration in FIG. 1 can also correspond to a narrowed position 50 and the socket connector 10 can firstly be transferred into a widened position by plugging in the plug contact 1.

In an embodiment shown, the socket connector 10 is attached to a cable 5 with a conductor 8. Electrical signals or electrical power can be transmitted to the plug contact 1 through the socket connector 10.

In the shown embodiment, the socket frame 3 includes a first catch 110 with a lock 111 positioned along a front region thereof with respect to the plug-in direction S. Through the first catch 22, the socket frame 3, in a narrowed position, can be retained in a corresponding body 2. The lock 111 may automatically lock in place when the socket frame 3 is inserted and thereby establishes a form-fit connection with the body 2.

The socket connector 10 furthermore has a second catch 120 along a rear region of the socket frame 3. The second catch 120 is configured to establish a form-fit connection with the body 2 in a first widened position 51. In a narrowed position, such a form-fit is not present in the region of the second catch 120, such that the socket connector 10 can simply be pushed into the body 2, for example through a slot (not shown) in a rear wall. The socket connector 10 in this case is typically pushed into the housing 2 counter to the plugging direction S. The second catch 120 then establishes a form-fit which acts in and counter to the plugging direction S. In contrast, the form-fit at the first catch 110 only acts in the plugging direction S.

In addition, the first catch 110 and the second catch 120 may include form-fit members 150, which act in and counter to a transverse direction Q, wherein the transverse direction Q runs perpendicular to the height direction H and perpendicular to the plugging direction S. As a result, the socket connector 10 can be effectively secured in the body 3.

According to the invention, the form-fit members 150 may include stop faces or protrusions.

The second catch 120 generally includes a protrusion 60 on the socket connector 10. In the embodiment shown, the protrusion 60 is attached to an upper side 12 thereof and protrudes relative to the upper side 12 in the height direction H.

The protrusion 60 is integral with the upper side 12 and has been formed by stamping or embossing from the upper side 12. The shown example of a protrusion 60 includes a bridge configuration in which a strip-shaped section is formed continuously.

Alternatively or additionally, the second catch 120 may include a protrusion 60.

Figure 3:
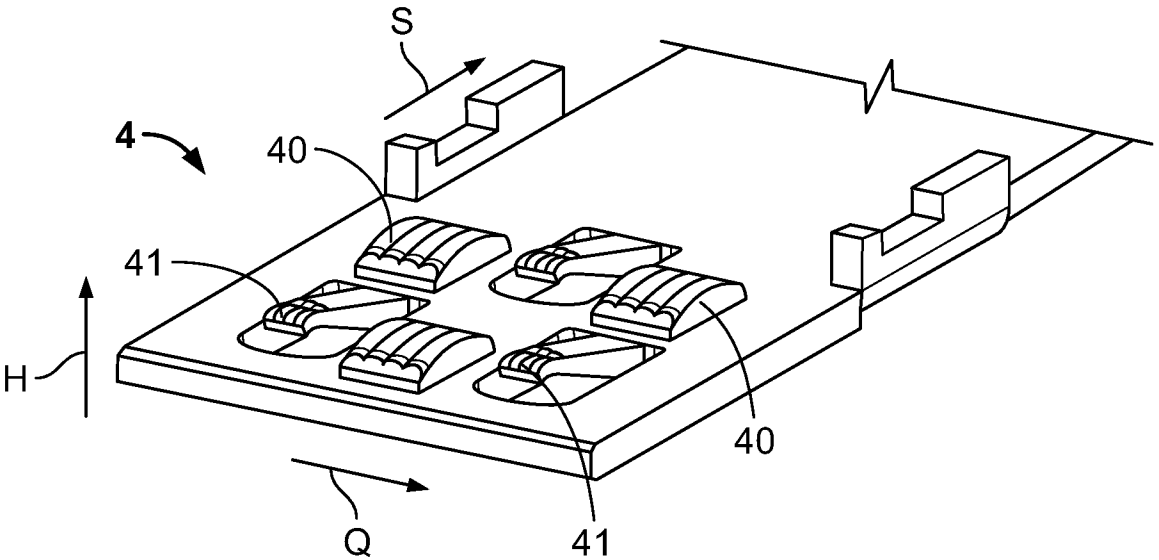
FIG. 3 is a perspective view of a contact assembly for the socket frame of FIG. 2.

The socket connector 10 shown in FIG. 1 also includes a contact assembly 4 (see FIG. 3) alongside the socket frame 3. The contact assembly 4 makes contact with the plug contact 1 and includes several contacts 40, 41 for this purpose. Some of the contacts 40 are shaped as rigid contacts 40, and further contacts 41 are shaped as flexible contacts 41, which have a contact surface, and are arranged, on tongues, to be deflectable counter to the height direction H.

Figure 2:
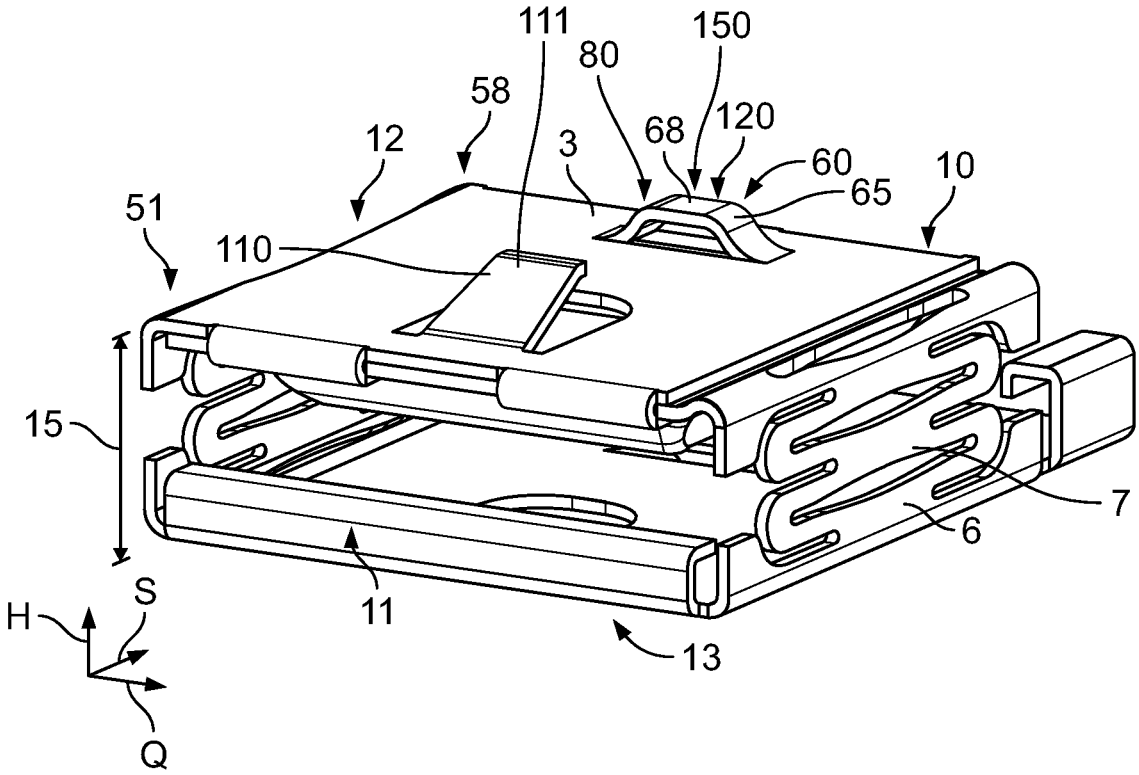
FIG. 2 is a perspective view of a socket frame of the socket connector of FIG. 1.

The protrusion 60 shown in FIGS. 1 and 2 is rigid, i.e. it is substantially non-flexible, in particular along a height direction H. As a result, socket frame 3 can be particularly secure.

The protrusion 60 is at the same time part of a force-fit assembly 80, with which the socket connector 10 can be retained in the body 2 in a force-fitting manner, if a plug contact 1 is introduced into the socket connector 10.

Figure 4:
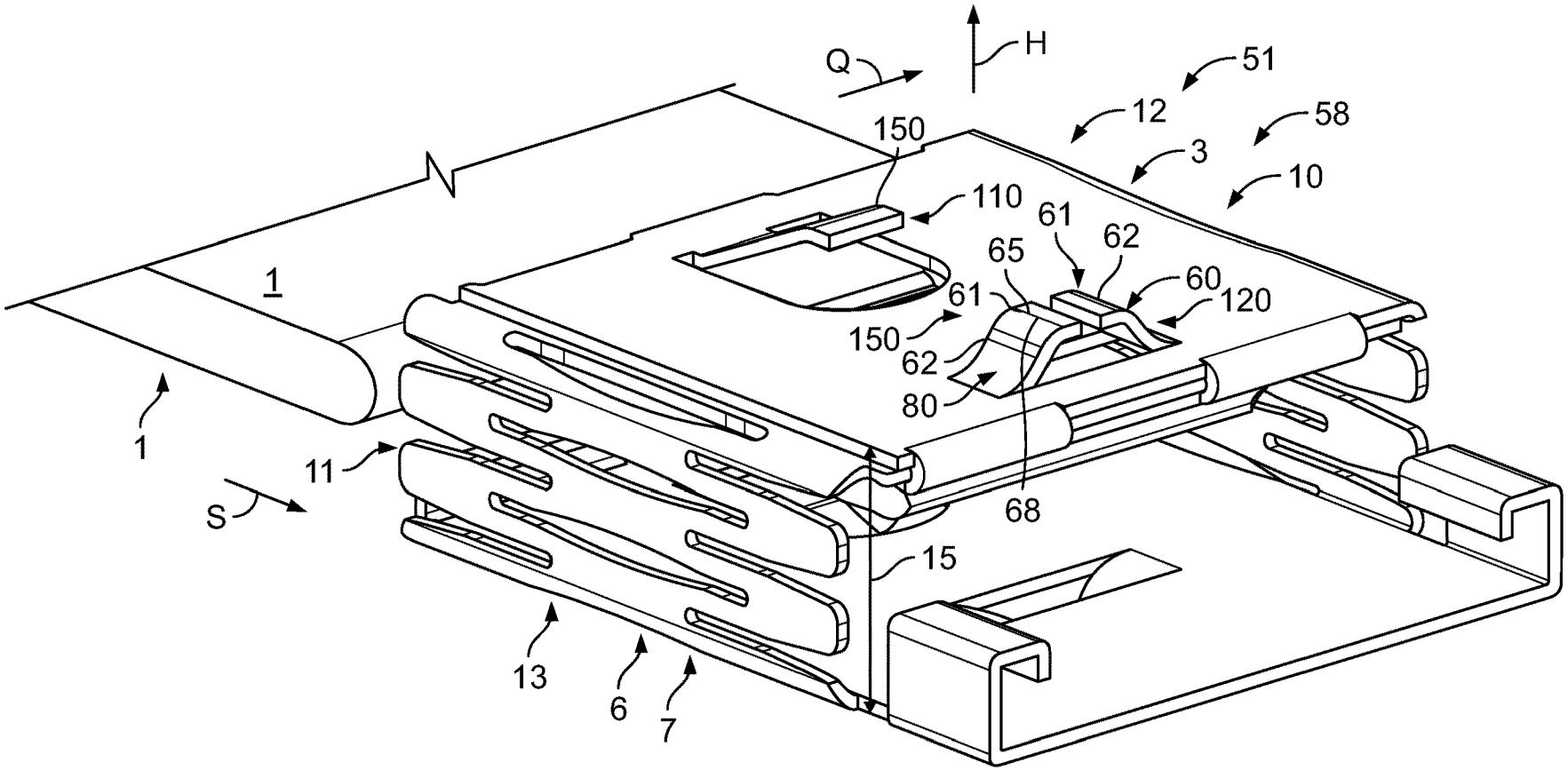
FIG. 4 is a perspective view of another a socket frame of a socket connector according to the invention.
Figure 5:
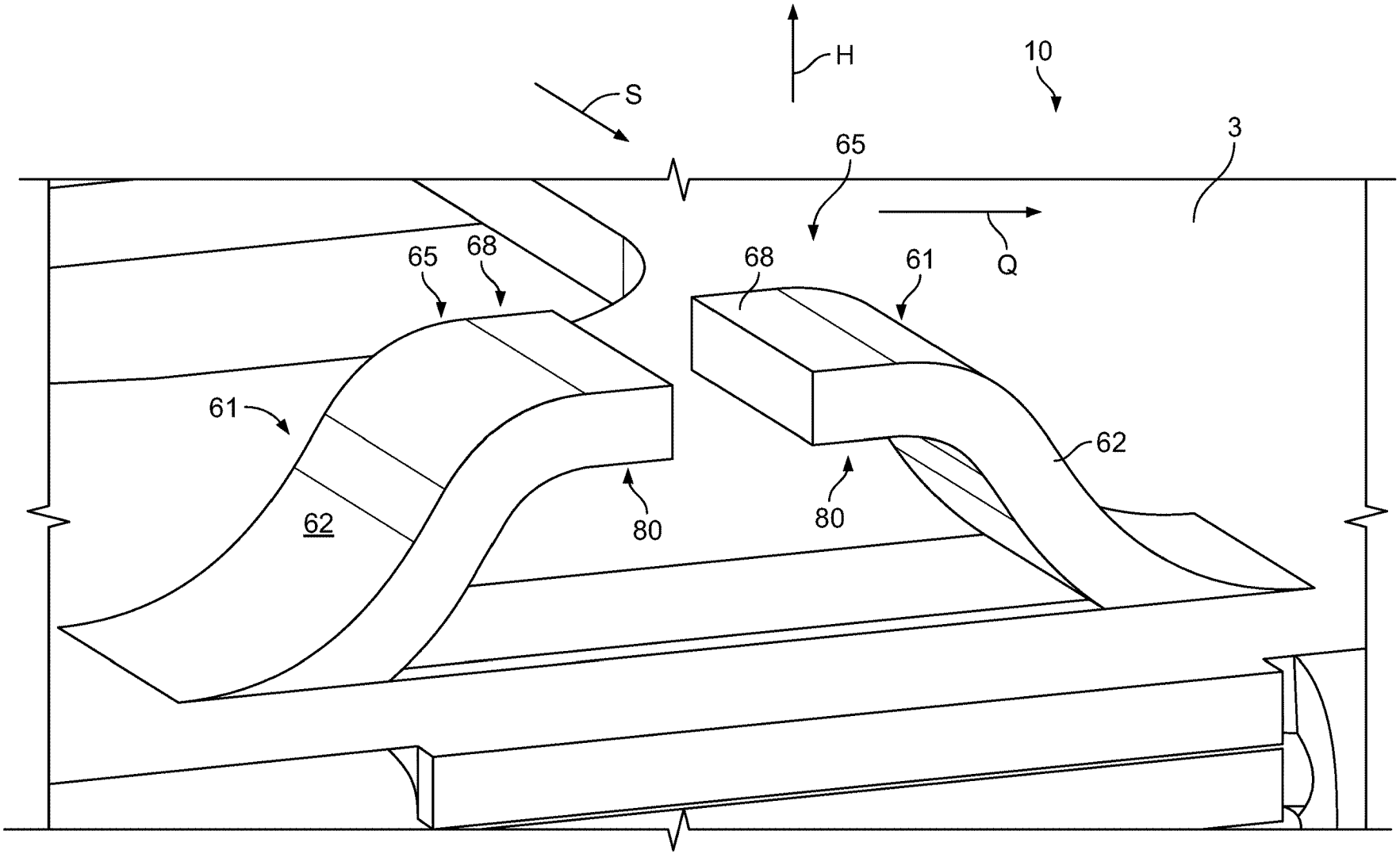
FIG. 5 is a close up view of the socket frame of FIG. 4.
Figure 6:
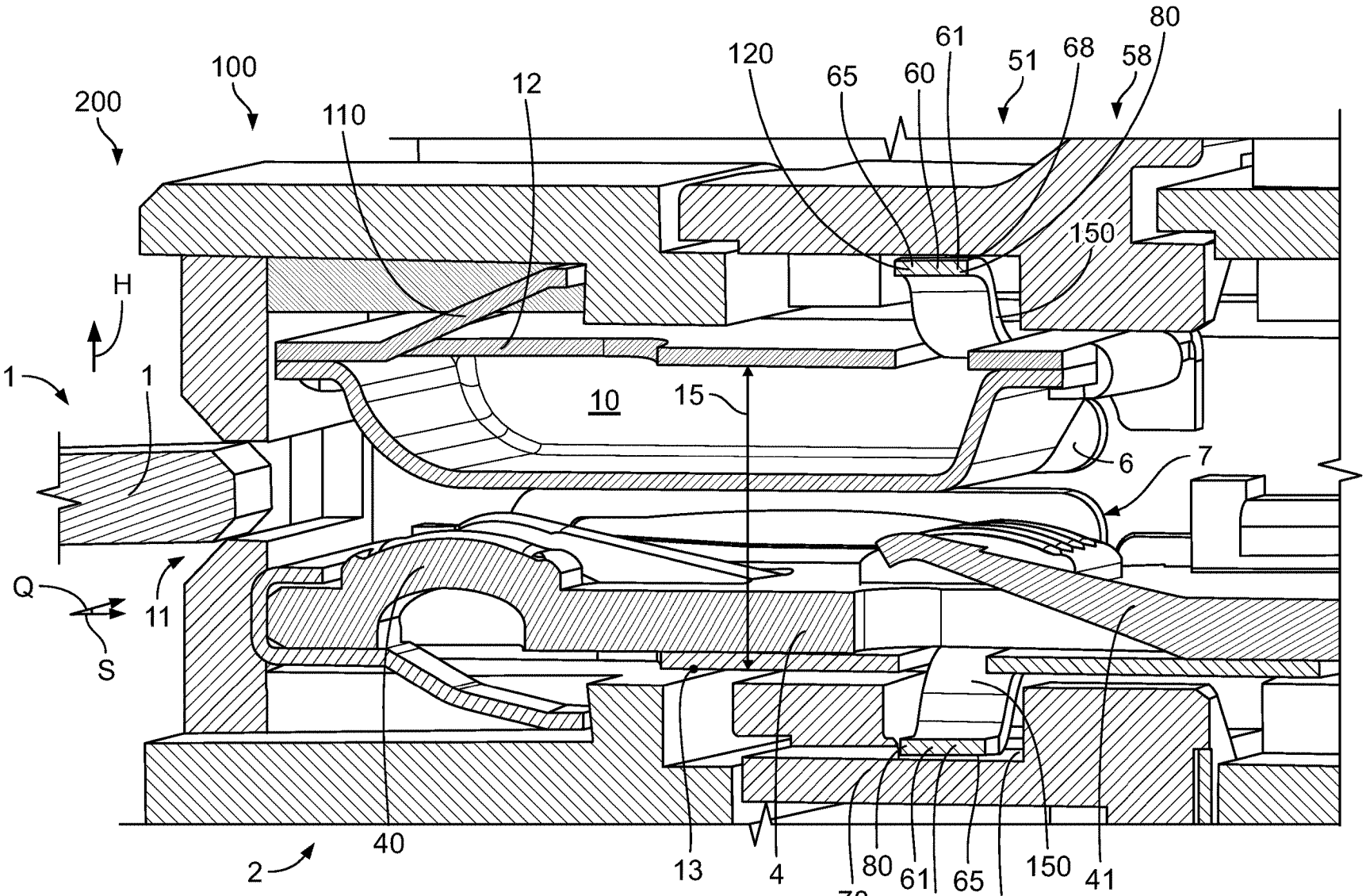
FIG. 6 is a sectional view of a socket connector according to the invention shown with a plug connector.

With reference to FIGS. 4 to 6, another socket connector 10 according to an embodiment of the invention is shown. A side wall 6 of a socket frame 3 is formed by a spring assembly 7, which allows the socket connector 10 and the receptacle 11 to expand in the height direction H. The spring assembly 7 is in this case formed by mutually connected legs or spring arms.

The shown embodiment also includes a first catch 110 with a form-fit member 150 in the form of a lock 111.

The second catch 120, which at the same time belongs to the force-fit assembly 80, is configured somewhat differently than embodiment shown in FIGS. 1 and 2. The second catch 120 is spaced apart from an upper side 12 of a socket frame 3 in the height direction H. However, in the shown embodiment, the second catch 120 includes a pair spring arms 12 which provide spring-deflection. The pair of spring arms 62 extend along the transverse direction Q and extend toward one another. In the embodiment shown, a gap is provided between the pair of spring arms 62 into which a form-fit element, for example, of the housing 2 can lock into place, in order to enable a form-fit in the transverse direction Q.

As shown in FIG. 6, the socket connector 10 is arranged in a body 2. A pair of protrusions 60, which are each part of a second catch 120 and of the force-fit assembly 80 and which are spaced further apart from an upper side 12 or a lower side 13 of the socket connector 10 respectively than in the embodiments from FIGS. 4 and 5, project into protrusion receiving spaces 70 in the body 2. As a result, a form-fit connection (in the plugging direction S) is achieved between the socket connector 10 and the body 2. In alternative configurations, there can also be a protrusion on the body 2, this protrusion interacts with the protrusion 60 on the socket connector 10 and generates a form-fit connection as a result.

The state shown in FIG. 6 is again a first widened position 51, which can morph into a second widened position 52 by pushing the plug contact 1 in the plugging direction S into the receptacle 11. In this second widened position, clamping surfaces 68 of the protrusions 60 along the outer ends 65 are stopped by corresponding clamping surfaces 78 of the protrusion receiving spaces 70. As a result, vibration behavior can be positively influenced, since the socket connector 10 is coupled more strongly to the body 2. As a result, in particular, movements of the plug contact 1 relative to the socket connector 10 can be reduced, so that contact surfaces 40, 41 experience a lower degree of wear.

The foregoing illustrates some of the possibilities for practicing the invention. Many other embodiments are possible within the scope and spirit of the invention. The combination of features shown and described in the individual exemplary embodiments serves solely the purposes of explanation. The disclosed invention utilizes the above identified components, as a system, in order to more efficiently construct an electrical connector for a particular purpose. Therefore, more or less of the aforementioned components can be used to conform to that particular purpose. In addition, according to the above statements, a further feature can be added in an exemplary embodiment if its technical effect is meant to be advantageous or necessary for a particular application. It is, therefore, intended that the foregoing description be regarded as illustrative rather than limiting, and that the scope of the invention is given by the appended claims together with their full range of equivalents.

What is claimed is:

1. A socket connector assembly, comprising:

a body; and a socket connector positioned in the body with a socket frame having an upper side, a lower side positioned opposite the upper side and a spring assembly connecting the upper side and the lower side such that the upper side is moveable relative to the lower side along a height direction, the socket frame defining a force fit assembly securing the body to the socket connector and including a first catch formed on the upper side proximate a front region thereof for securing the body to the socket connector after insertion and a second catch formed on the upper side proximate a rear region thereof.

2. The socket connector assembly according to claim 1, further comprising a contact assembly positioned alongside the socket frame.

3. The socket connector assembly according to claim 2, wherein the contact assembly includes a plurality of contacts having plug contact surfaces.

4. The socket connector assembly according to claim 1, wherein the first catch is a lock extending upward from the upper side.

5. The socket connector assembly according to claim 4, wherein the lock extends along a plug-in direction.

6. The socket connector assembly according claim 5, wherein the second catch secures the body to the socket connector when the upper side moves relative to the lower side.

7. The socket connector assembly according to claim 6, wherein the second catch extends upward from the upper side in the height direction.

8. The socket connector assembly according to claim 7, wherein the second catch includes a pair of catch spring arms separated by a gap.

9. The socket connector assembly according to claim 8, wherein the pair of catch spring arms extend toward each other from the upper side and along a transverse direction with respect to the plug-in direction.

10. The socket connector assembly according to claim 9, wherein the pair of catch spring arms comprise cantilevered arms having free ends extending toward each other along a transverse direction with respect to the plug-in direction.

11. The socket connector assembly according to claim 6, wherein the second catch includes a protrusion extending from the socket connector.

12. The socket connector assembly according to claim 11, wherein the protrusion is a spring arm generating a spring force along the height direction.

13. The socket connector assembly according to claim 12, wherein the spring arm extends toward the body.

14. The socket connector assembly according to claim 11, wherein the protrusion is integrally formed with the upper side.

15. The socket connector assembly according to claim 14, wherein the protrusion is stopped by a protrusion receiving space positioned along an inner wall of the body.

16. The socket connector assembly according to claim 14, wherein the protrusion is stamped from the upper side.

17. The socket connector assembly according to claim 16, wherein the protrusion is rigid.

18. A socket connector assembly, comprising:

a body;

a socket connector positioned in the body with a socket frame having an upper side, a lower side positioned opposite the upper side and a spring assembly connecting the upper side and the lower side such that the upper side is moveable relative to the lower side along a height direction, the spring assembly including a pair of side walls, each sidewall having a plurality of interconnected spring legs extending and movable relative to one another in the height direction for connecting the upper side and the lower side; and a force fit assembly securing the body to the socket connector.

19. A socket connector assembly, comprising:

a body;

a socket connector positioned in the body with a socket frame having an upper side, a lower side positioned opposite the upper side and a spring assembly connecting the upper side and the lower side such that the upper side is moveable relative to the lower side along a height direction;

a force fit assembly securing the body to the socket connector; and a contact assembly positioned within the socket frame for making electrical contact with a contact plug inserted into the socket connector, the contact assembly including a plurality of rigid contacts and a plurality of flexible contacts having plug contact surfaces for engaging with and electrically connecting to the contact plug.

20. The socket connector assembly according to claim 19, wherein the plurality of flexible contacts are deflectable counter to the height direction.

* * * * *